US009244408B2

(12) United States Patent
Inoue et al.

(10) Patent No.: US 9,244,408 B2
(45) Date of Patent: Jan. 26, 2016

(54) FIXING DEVICE AND IMAGE FORMING APPARATUS

(71) Applicant: FUJI XEROX CO., LTD., Minato-ku, Tokyo (JP)

(72) Inventors: Toru Inoue, Kanagawa (JP); Junpei Amano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 27 days.

(21) Appl. No.: 14/134,540

(22) Filed: Dec. 19, 2013

(65) Prior Publication Data

US 2014/0348558 A1 Nov. 27, 2014

(30) Foreign Application Priority Data

May 24, 2013 (JP) ..... 2013-109549

(51) Int. Cl.
*G03G 15/20* (2006.01)

(52) U.S. Cl.
CPC ..... *G03G 15/206* (2013.01); *G03G 15/2064* (2013.01); *G03G 2215/2038* (2013.01)

(58) Field of Classification Search
CPC ..... G03G 15/206; G03G 15/2017; G03G 15/2089
USPC ..... 399/329
See application file for complete search history.

(56) References Cited

U.S. PATENT DOCUMENTS

2013/0195522 A1* 8/2013 Kasama ..... 399/329
2013/0251419 A1* 9/2013 Kimura et al. ..... 399/329

FOREIGN PATENT DOCUMENTS

JP 2004-53618 A 2/2004
JP 2007-140562 A 6/2007
JP 2009-237120 A 10/2009

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

A fixing device includes an endless belt member, a fixed member that is in contact with an inner circumferential surface of the belt member, a heating member configured to heat the belt member, and a pressing member including at least a pressing roller that includes an elastic surface layer and presses the belt member against the fixed member from an outer circumferential side of the belt member in such a manner as to form a fixing part through which a recording object carrying an unfixed image is made to pass. A center, in a direction of rotation of the pressing roller, of a contact part of the fixed member that is in contact with the pressing roller through the belt member resides at a position that is displaced toward an entrance side of the fixing part with respect to a center of rotation of the pressing roller.

5 Claims, 14 Drawing Sheets

FIG. 7

| | | | DISPLACEMENT (mm) | | | | | |
|---|---|---|---|---|---|---|---|---|
| | | | 0 | 0.8 | 1.6 | 2.4 | 3.2 | 4.0 |
| NIPPING PRESSURE (kgf/cm$^2$) | DISTANCE FROM NIP ENTRANCE (mm) | 0 | 1 | 1 | 1 | 1 | 1 | 1 |
| | | 5.2 | 3.9 | 3.9 | 3.9 | 3.9 | 3.9 | 3.9 |
| | | 8.5 | – | 3.5 | 3.6 | 3.7 | 3.8 | 4.0 |
| | | 10 | – | 2.9 | 3.4 | 3.9 | 4.5 | 4.9 |
| | | 12 | 1 | 1 | 1 | 1 | 1 | 1 |
| PRESSURE AT NIP EXIT (kgf/cm$^2$) | | | 2.5 | 3.0 | 3.5 | 4.0 | 4.5 | 5.0 |
| RATING OF SEPARABILITY (LENGTH OF MARGIN AT LEADING END OF SHEET: mm) | | | 5 | 4 | 3 | 2 | 1 | 0 |
| RATING OF STATE OF SHEET WARPED | | | GOOD | GOOD | FAIR | FAIR | POOR | POOR |

FIXING DEVICE AND IMAGE FORMING APPARATUS

CROSS-REFERENCE TO RELATED APPLICATIONS

This application is based on and claims priority under 35 USC 119 from Japanese Patent Application No. 2013-109549 filed May 24, 2013.

BACKGROUND (i) Technical Field

The present invention relates to a fixing device and an image forming apparatus.

(ii) Related Art

Different types of fixing devices configured to fix unfixed images, such as toner images, to recording objects, such as recording sheets, have been proposed in recent years.

SUMMARY

According to an aspect of the invention, there is provided a fixing device including an endless belt member, a fixed member fixedly provided and being in contact with an inner circumferential surface of the belt member, a heating member configured to heat the belt member, and a pressing member including at least a pressing roller that rotates when driven and includes an elastic surface layer, the pressing roller being configured to press the belt member against the fixed member from an outer circumferential side of the belt member in such a manner as to form a fixing part through which a recording object carrying an unfixed image is made to pass, the elastic surface layer undergoing elastic deformation when the fixing part is formed. A center, in a direction of rotation of the pressing roller, of a contact part of the fixed member that is in contact with the pressing roller through the belt member resides at a position that is displaced toward an entrance side of the fixing part with respect to a center of rotation of the pressing roller.

BRIEF DESCRIPTION OF THE DRAWINGS

Exemplary embodiments of the present invention will be described in detail based on the following figures, wherein:

FIG. 7 is a table summarizing the parameters and the results of the evaluation test;

DETAILED DESCRIPTION

First Exemplary Embodiment

Figure 1:
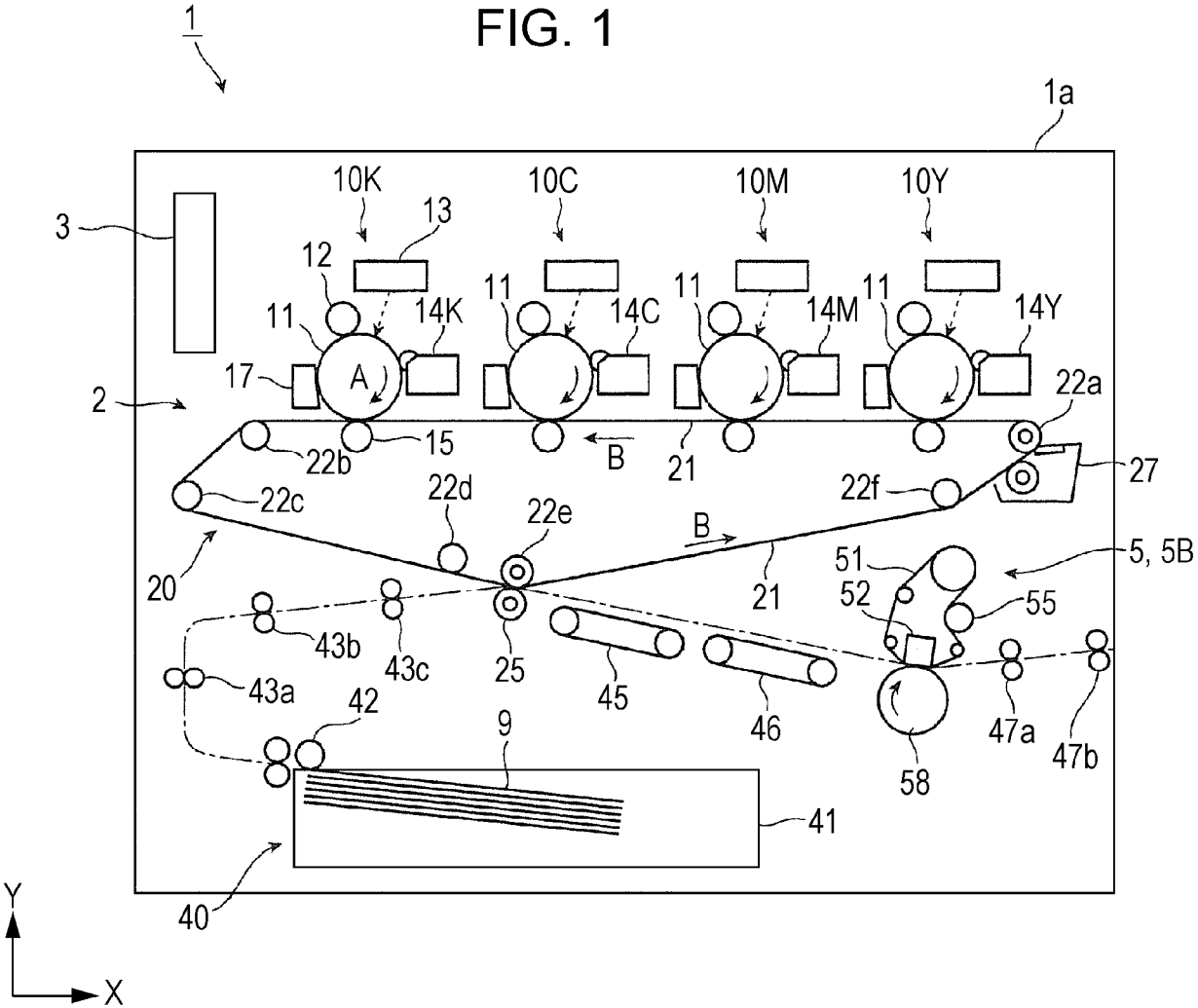
FIG. 1 schematically illustrates an image forming apparatus including a fixing device according to first and other exemplary embodiments.
Figure 2:
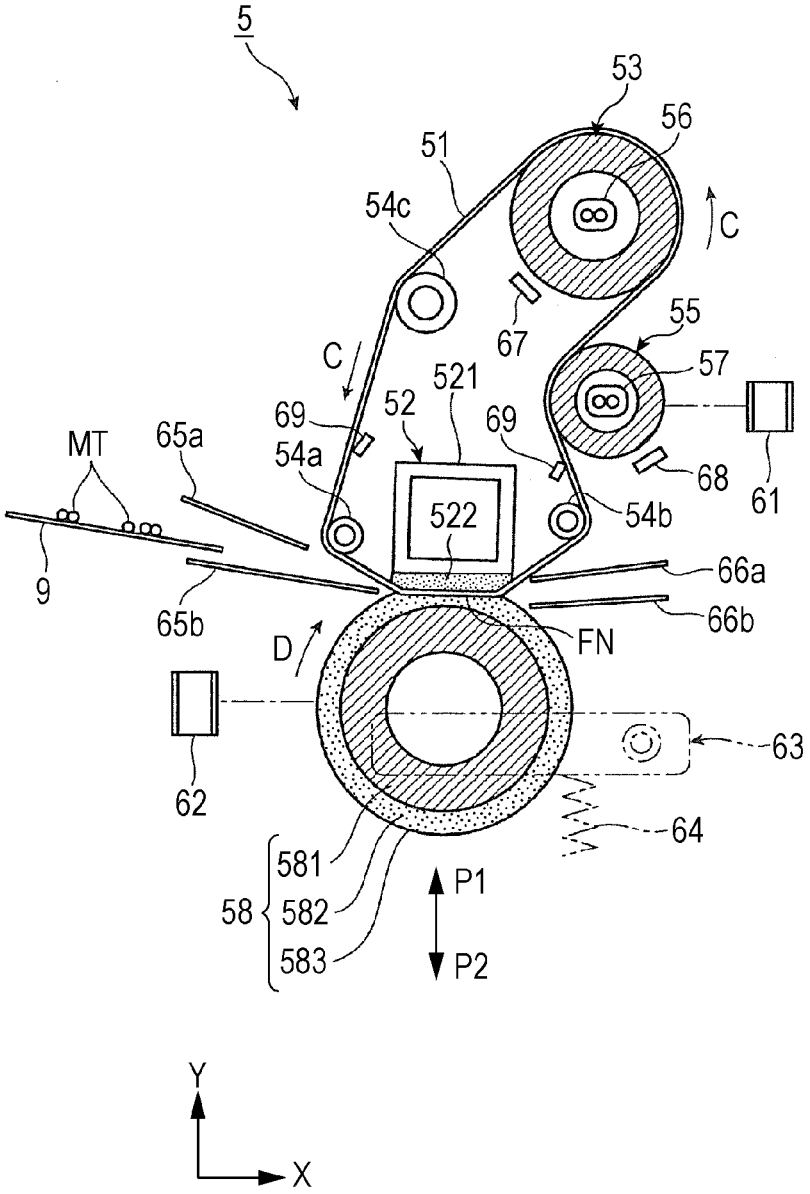
FIG. 2 is a schematic front view of the fixing device included in the image forming apparatus illustrated in FIG. 1.
Figure 3:
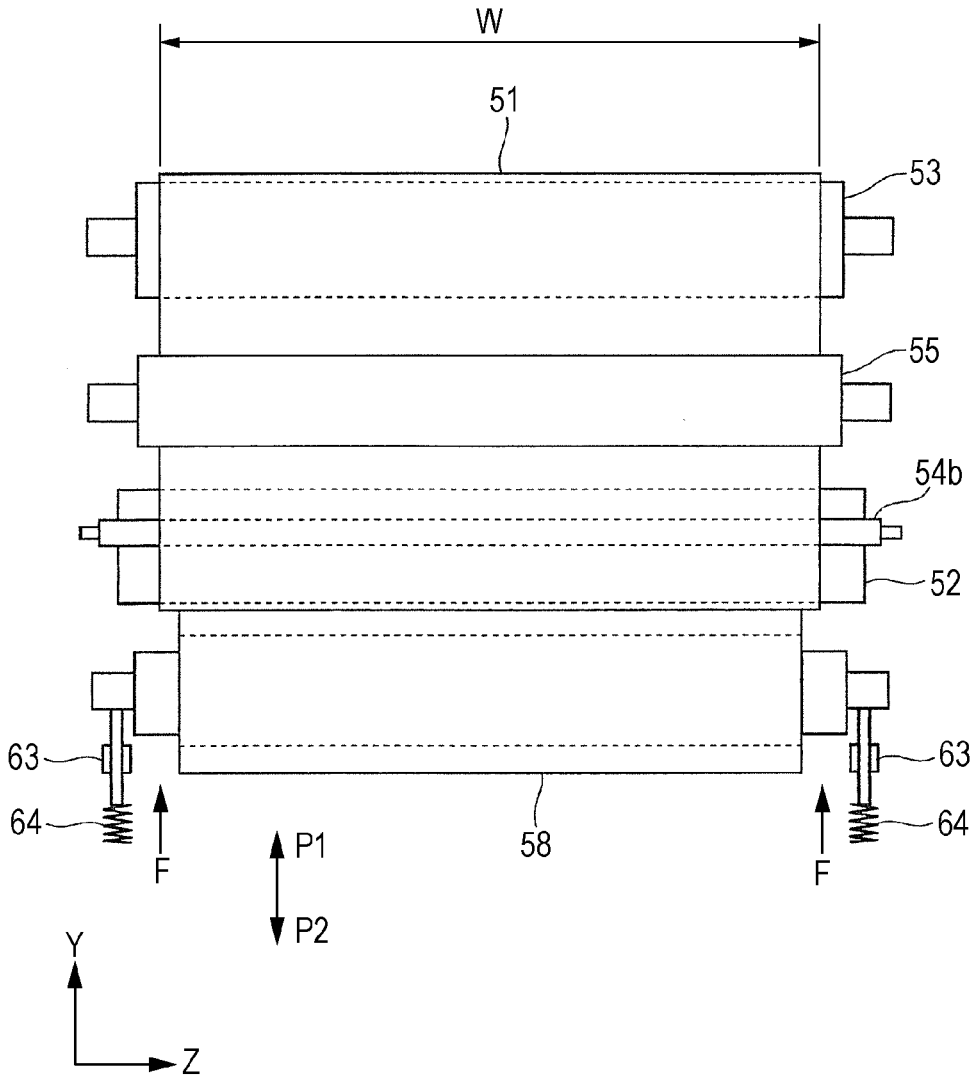
FIG. 3 is a schematic side view of the fixing device illustrated in FIG. 2.

FIGS. 1 to 3 illustrate an image forming apparatus 1 including a fixing device 5 according to a first exemplary embodiment. FIG. 1 schematically illustrates the entirety of the image forming apparatus 1. FIG. 2 is a schematic front view of the fixing device 5. FIG. 3 is a schematic side view (seen from a sheet exit side) of the fixing device 5.

Configuration of Image Forming Apparatus

The image forming apparatus 1 according to the first exemplary embodiment is, for example, a color printer. As illustrated in FIG. 1, the image forming apparatus 1 includes an image forming section 2 that forms a toner image as an exemplary unfixed image on a recording sheet 9, the fixing device 5 that fixes the toner image formed by the image forming section 2 to the recording sheet 9, a controller 3 that controls operations performed by elements such as the image forming section 2 and the fixing device 5, and so forth. The image forming apparatus 1 has a housing 1*a*, in which the recording sheet 9 is transported along a transport path illustrated by the dash-dot line in FIG. 1.

The image forming section 2 includes plural image forming devices 10 that form respective toner images by using toners functioning as developers, an intermediate transfer device 20 to which the toner images formed by the image forming devices 10 are first-transferred and that ultimately transports the toner images to a second transfer position where the toner images are second-transferred to a recording sheet 9, and a sheet feeding device 40 that contains recording sheets 9 to be fed to the second transfer position defined in the intermediate transfer device 20 and transports each of the recording sheets 9.

The image forming devices 10 includes four image forming devices 10Y, 10M, 10C, and 10K that electrophotographically form toner images in four respective colors of yellow (Y), magenta (M), cyan (C), and black (K). The four image forming devices 10 (Y, M, C, and K) are aligned substantially horizontally, for example, and have a substantially common configuration as to be described below, except that the kinds (colors) of the developers to be used are different.

Specifically, the image forming devices 10 (Y, M, C, and K) each include a photoconductor drum 11 that rotates in a direction of arrow A, a charging device 12 that charges the circumferential surface (image carrying surface) of the photoconductor drum 11 to a predetermined potential, an exposure device 13 that applies light generated from image information (a signal) to the charged circumferential surface of the photoconductor drum 11 and thus forms an electrostatic latent image on the photoconductor drum 11, a developing device 14 (Y, M, C, or K) that develops the electrostatic latent image into a toner image with a corresponding one of the toners as a developer having a corresponding one of the colors (Y, M, C, and K), a first transfer device 15 that is in the form of a roller or the like and transfers the toner image to the intermediate transfer device 20, a drum cleaning device 17 that removes foreign matter such as toner remaining on the image carrying surface of the photoconductor drum 11 having undergone the first transfer, and so forth.

The intermediate transfer device 20 is provided below the image forming devices 10 (Y, M, C, and K). The intermediate transfer device 20 includes an intermediate transfer belt 21 that rotates in a direction of arrow B while passing through first transfer positions defined between the photoconductor drums 11 and the respective first transfer devices 15 (first transfer rollers), plural belt supporting rollers 22*a* to 22*f* that rotatably support and retain the intermediate transfer belt 21 in a predetermined state from the inner circumferential side of the intermediate transfer belt 21, a second transfer device 25 that is in the form of a roller and second-transfers the toner images on the intermediate transfer belt 21 to a recording sheet 9, a belt cleaning device 27 that removes foreign matter such as toner and paper lint remaining on the outer circumferential surface of the intermediate transfer belt 21 having passed through the second transfer device 25, and so forth. Among the plural belt supporting rollers 22*a* to 22*f*, the belt supporting roller 22*a* functions as a driving roller, and the belt supporting roller 22*c* functions as a tension applying roller. The second transfer device 25 forms a second transfer part (the second transfer position) by pressing the intermediate transfer belt 21 against the belt supporting roller 22*e*.

The sheet feeding device 40 is provided below the intermediate transfer device 20 and the second transfer device 25. The sheet feeding device 40 includes a single (or plural) sheet container 41 that contains a stack of recording sheets 9 having a predetermined size, type, and other conditions, and a feeder 42 that feeds each of the recording sheets 9 from the sheet container 41. Plural pairs of sheet transport rollers 43*a* to 43*c* that transport the recording sheet 9 fed thereto from the sheet feeding device 40 to the second transfer position, and a sheet transport path including transport guide members (not illustrated) are provided between the sheet feeding device 40 and the second transfer position (the contact part between the intermediate transfer belt 21 and the second transfer device 25) defined in the intermediate transfer device 20. The pair of sheet transport rollers 43*c* provided immediately before the second transfer position functions as, for example, a pair of rollers (registration rollers) that adjusts the timing of transporting the recording sheet 9.

Sheet transport devices 45 and 46 that are in the form of belts or the like are provided between the second transfer part defined in the intermediate transfer device 20 and the fixing device 5. The sheet transport devices 45 and 46 transport, to the fixing device 5, the recording sheet 9 having undergone the second transfer and having been separated from the intermediate transfer belt 21. Furthermore, a sheet discharge path including pairs of sheet discharge rollers 47*a* and 47*b* and so forth is provided between the fixing device 5 and a sheet discharge port provided in the housing 1*a*. The recording sheet 9 having undergone fixing and having been discharged from the fixing device 5 is discharged to the outside of the housing 1*a* by the pairs of sheet discharge rollers 47*a* and 47*b*.

Basic Operation of Image Forming Apparatus

A basic image forming operation performed by the image forming apparatus 1 will now be described. The following description concerns, as a typical example, an operation of forming a full-color image composed of toner images having four colors (Y, M, C, and K) formed by the four respective image forming devices 10 (Y, M, C, and K) included in the image forming section 2.

When the controller 3 of the image forming apparatus 1 receives a command requesting an image forming operation (a printing request), the photoconductor drums 11 of the image forming devices 10 (Y, M, C, and K) included in the image forming section 2 start to rotate in the direction of arrow A. Subsequently, the charging devices 12 charge the circumferential surfaces of the photoconductor drums 11 to a predetermined polarity (negative polarity in the first exemplary embodiment) and to a predetermined potential. Subsequently, the exposure devices 13 apply, to the charged circumferential surfaces of the photoconductor drums 11, beams of light generated from image signals obtained by conversion of image information that has been input to the image forming apparatus 1 into pieces of information for the respective color components (Y, M, C, and K), whereby electrostatic latent images having the predetermined potential are formed for the respective color components on the circumferential surfaces of the photoconductor drums 11.

Subsequently, the developing devices 14 (Y, M, C, and K) supply, via developing rollers or the like, the toners having the respective colors (Y, M, C, and K) and having been charged to a predetermined polarity (negative polarity) to the electrostatic latent images for the respective color components on the photoconductor drums 11, whereby the toners electrostatically adhere to the photoconductor drums 11, and the electrostatic latent images are thus developed. Through such a development process, toner images having the four respective colors (Y, M, C, and K) are formed on the respective photoconductor drums 11.

Subsequently, the toner images in the respective colors on the photoconductor drums 11 of the image forming devices 10 (Y, M, C, and K) are transported to the respective first transfer positions, where the first transfer devices 15 first-transfer the toner images in the respective colors sequentially to the outer circumferential surface of the intermediate transfer belt 21 of the intermediate transfer device 20 that is rotating in the direction of arrow B. Thus, the toner images are superposed one on top of another, and a superposition of toner images is formed on the intermediate transfer belt 21. In the image forming devices 10 having undergone the first transfer, the drum cleaning devices 17 clean the circumferential surfaces of the respective photoconductor drums 11 having undergone the first transfer.

Subsequently, the intermediate transfer belt 21 of the intermediate transfer device 20 rotates, whereby the superposition of toner images having been first-transferred thereto is transported to the second transfer position. Meanwhile, the sheet feeding device 40 feeds a recording sheet 9 into the sheet transport path synchronously with the image forming operation. In the sheet transport path, the pair of sheet transport rollers 43*c* as a pair of registration rollers sends the recording sheet 9 to the second transfer position in accordance with the timing of transfer.

At the second transfer position, the second transfer device 25 second-transfers the superposition of toner images carried by the intermediate transfer belt 21 to the recording sheet 9. In the intermediate transfer device 20 having undergone the second transfer, the belt cleaning device 27 cleans the outer circumferential surface of the intermediate transfer belt 21 having undergone the second transfer.

Subsequently, the recording sheet 9 having the superposition of toner images second-transferred thereto is separated from the intermediate transfer belt 21 and is then transported to the fixing device 5 by the sheet transport devices 45 and 46. In the fixing device 5, the superposition of toner images that is yet to be fixed is fixed to the recording sheet 9 through a predetermined fixing process (heating and pressing) as to be described separately below. Lastly, if the image forming operation is for forming an image on one side of the recording sheet 9, the recording sheet 9 having undergone fixing is discharged along the sheet discharge path toward an output receiving portion (not illustrated) provided on, for example, the outside of the housing 1*a*.

Through the above image forming operation, the recording sheet 9 having a full-color image composed of the toner images in the four respective colors is output.

Configuration of Fixing Device

The fixing device 5 will now be described.

Figure 4:
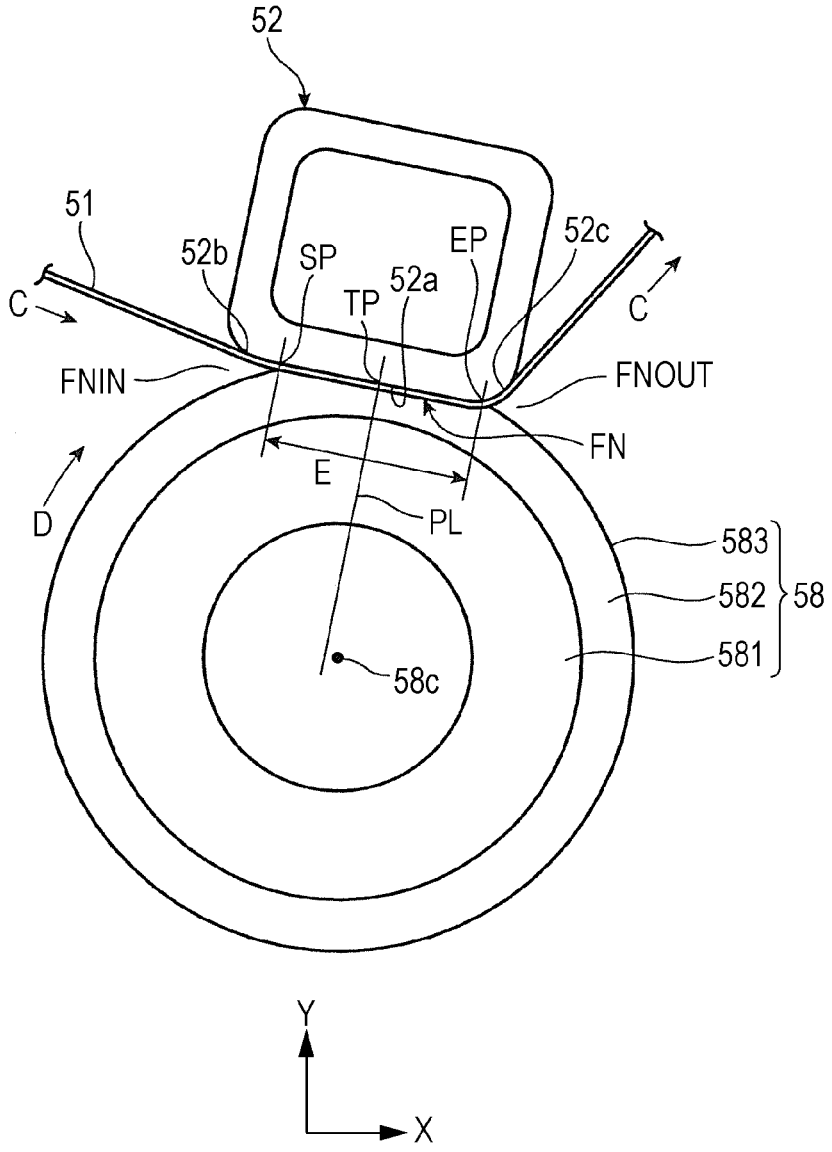
FIG. 4 is an enlarged view of the fixing device illustrated in FIG. 2 and illustrates the position of a fixed member included therein.

Referring to FIGS. 2 to 4 and others, the fixing device 5 includes at least the following: a fixing belt 51 as an endless belt member, a fixed member (fixed pad) 52 fixedly provided and being in contact with the inner circumferential surface of the fixing belt 51, inner supporting rollers 53 and 54*a* to 54*c* rotatably supporting the fixing belt 51 in combination with the fixed member 52 by being in contact with the inner circumferential surface of the fixing belt 51, an outer supporting roller 55 rotatably supporting the fixing belt 51 in combination with the fixed member 52 and the inner supporting rollers 53 and 54*a* to 54*c* by being in contact with the outer circumferential surface of the fixing belt 51, halogen heaters 56 and 57 as exemplary heating members configured to heat the fixing belt 51 via the inner supporting roller 53 and the outer supporting roller 55, respectively, and a pressing roller 58 as an exemplary pressing member configured to form a fixing part FN by pressing the fixing belt 51 against the fixed member 52. A recording sheet 9 having an unfixed toner image MT is made to pass through the fixing part FN. The fixing part FN is a contact part (nip) between the pressing roller 58 and a portion of the fixing belt 51 supported by the fixed member 52. A process (pressing and heating) of fixing the unfixed toner image MT to the recording sheet 9 is performed at the contact part.

The fixing belt 51 includes, for example, an endless belt base, an elastic layer provided over the surface (outer circumferential surface) of the base, and a release layer provided over the elastic layer. The base is made of a material such as polyimide and has a thickness of, for example, 30 to 100 μm. The elastic layer is made of an elastic material such as silicone rubber and has a thickness of, for example, 300 to 500 μm. The release layer is made of a material such as tetrafluoroethylene-perfluoroalkylvinyl ether copolymer (PFA) and has a thickness of, for example, 10 to 50 μm. The fixing belt 51 as a whole has a thickness t of, for example, 0.1 to 1.0 mm. The fixing belt 51 has a belt width W (see FIG. 3) that is larger than the width of a recording sheet 9 having the largest transportable size. The fixing belt 51 is long enough to be stretched around the fixed member 52 and the plural supporting rollers 53 to 55.

The fixed member 52 includes a supporting member 521 fixedly provided and having a rectangular tubular shape, and a slide member 522 provided on a surface of the supporting member 521 that is in contact with the inner circumferential surface of the fixing belt 51. The supporting member 521 is made of, for example, metal such as iron or stainless steel or a material such as liquid crystal polymer. The slide member 522 is made of, for example, fluororesin such as tetrafluoroethylene-perfluoroalkoxy ethylene copolymer (PFA). A portion of the slide member 522 that is in contact with the inner circumferential surface of the fixing belt 51 is substantially flat. Other details of the fixed member 52 will be described separately below.

The inner supporting roller 53 is a cylindrical roller made of aluminum or the like and is rotatably provided at the position farthest from the fixed member 52. The inner supporting roller 53 includes the halogen heater 56 as an exemplary heating member that is provided in an inner space thereof. Hence, the inner supporting roller 53 functions as an inner heating roller that heats the fixing belt 51 from the inner circumferential side of the fixing belt 51. The inner supporting roller 53 is provided with a temperature detector 67 that detects the surface temperature of the inner supporting roller 53. The inner supporting roller 53 also functions as a tension applying roller that applies a predetermined tension to the fixing belt 51 by supporting the fixing belt 51 while elastically pressing the fixing belt 51 from the inner circumferential side toward the outer circumferential side of the fixing belt 51.

The inner supporting roller 54*a* functions as an approaching-position-retaining roller that retains the position of the fixing belt 51 before the fixing belt 51 comes into contact with the fixed member 52. The inner supporting roller 54*a* is rotatably provided near the fixed member 52 and on a side of the fixed member 52 from which the fixing belt 51 approaches the fixed member 52. The inner supporting roller 54*b* functions as a leaving-position-retaining roller that retains the position of the fixing belt 51 after the fixing belt 51 leaves the fixed member 52. The inner supporting roller 54*b* is rotatably provided near the fixed member 52 and on a side of the fixed member 52 from which the fixing belt 51 leaves the fixed member 52. The inner supporting roller 54*c* functions as a position correcting roller that corrects the position of the fixing belt 51 that is under rotation. The inner supporting roller 54*c* is rotatably provided between the inner supporting roller 53 and the inner supporting roller 54*a*.

The outer supporting roller 55 is a cylindrical roller made of aluminum or the like and is rotatably provided between the inner supporting roller 53 and the inner supporting roller 54*b* while being pressed against the outer circumferential surface of the fixing belt 51. The outer supporting roller 55 includes the halogen heater 57 as an exemplary heating member that is provided in an inner space thereof. Hence, the outer supporting roller 55 functions as an outer heating roller that heats the fixing belt 51 from the outer circumferential side of the fixing belt 51. The outer supporting roller 55 is provided with a temperature detector 68 that detects the surface temperature of the outer supporting roller 55. The outer supporting roller 55 is driven to rotate at a predetermined timing by a first driving device 61 including a driving motor and so forth. Hence, the outer supporting roller 55 is capable of rotating the fixing belt 51 in a direction of arrow C by being in contact with the outer circumferential surface of the fixing belt 51.

The fixing belt 51 is stretched around the fixed member 52 and the inner supporting rollers 53 and 54 in such a manner as to be supported from the inner circumferential side thereof by the fixed member 52 and the inner supporting rollers 53 and 54 and from the outer circumferential side thereof by the outer supporting roller 55. Thus, the fixing belt 51 is rotatable. The fixing belt 51 receives a predetermined tension applied thereto by the inner supporting roller 53 functioning as a tension applying roller, thereby retaining the state of being stretched around the plural supporting rollers including the fixed member 52.

The pressing roller 58 includes a cylindrical base roller 581 made of aluminum or the like, an elastic surface layer 582 made of silicone rubber or the like and provided over the cylindrical base roller 581, and a release layer 583 made of PFA or the like and provided over the elastic surface layer 582. As illustrated in FIGS. 2 and 4, the elastic surface layer 582 elastically deforms when the pressing roller 58 presses the fixing belt 51 against the fixed member 52 and thus forms the fixing part FN. Therefore, the elastic surface layer 582 is designed to be, for example, harder than the fixed member 52.

The pressing roller 58 is at least longer than the width of a recording sheet 9 having the largest transportable size. In the first exemplary embodiment, the pressing roller 58 has a width slightly smaller than the width W of the fixing belt 51.

Figure 5:
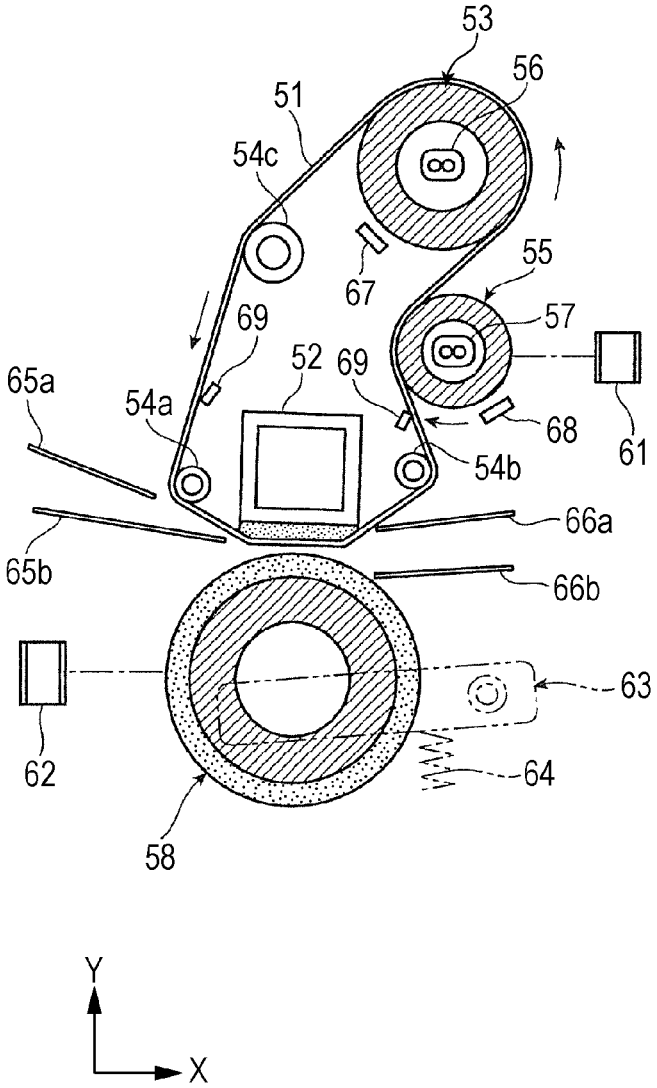
FIG. 5 illustrates the fixing device illustrated in FIG. 2 with a pressing roller thereof being at a second position.

The pressing roller 58 is rotatably supported at a position facing the fixed member 52 and is supported by a moving mechanism 63, which moves the pressing roller 58 between the following two positions: a first position P1 illustrated in FIG. 2 where the pressing roller 58 is pressed against the fixing belt 51 and forms the fixing part FN, and a second position P2 illustrated in FIG. 5 where the pressing roller 58 is spaced apart from the fixing belt 51. The first position P1 is also regarded as a pressing position where the pressing roller 58 is pressed against the fixing belt 51 supported by the fixed member 52. The second position P2 is also regarded as an away position where the pressing roller 58 is out of contact with the fixing belt 51.

The moving mechanism 63 is, for example, a mechanism that moves a supporting frame, on which the pressing roller 58 is rotatably supported, with the aid of moving members such as cams. The pressing roller 58 is moved to the first position (pressing position) P1 when a fixing step included in the image forming operation performed by the image forming section 2 is executed. However, the pressing roller 58 is basically at the second position (away position) P2, except the situations to be described separately below.

The pressing roller 58 is subject to a predetermined pressure F applied thereto toward the fixed member 52 by a pressing mechanism 64 (see FIG. 3). The pressing mechanism 64 includes spring members or the like and functions in combination with the moving mechanism 63. The pressing roller 58 is driven to rotate at a predetermined timing by a second driving device 62 including a driving motor and so forth. Hence, the pressing roller 58 that is at the first position P1 is capable of rotating the fixing belt 51 in the direction of arrow C by being driven to rotate while being in contact with the outer circumferential surface of the fixing belt 51 that is pressed against the fixed member 52.

As illustrated in FIG. 2, the fixing device 5 includes entrance-side guiding members 65 provided near the fixing part FN and on an entrance side of the fixing part FN. The entrance-side guiding members 65 guide a recording sheet 9 carrying an unfixed toner image MT toward the entrance of the fixing part FN. The fixing device 5 further includes exit-side guiding members 66 provided near the fixing part FN and on an exit side of the fixing part FN. The exit-side guiding members 66 guide the recording sheet 9 having undergone fixing and exiting from the fixing part FN. A lower guiding member 66*b* included in the exit-side guiding members 66 that is provided nearer to the pressing roller 58 has a separating tip having a tapered shape so as to separate the recording sheet 9 exiting from the fixing part FN from the outer circumferential surface of the pressing roller 58. The lower guiding member 66*b* is positioned with the separating tip thereof being lightly in contact with the outer circumferential surface of the pressing roller 58. Lubricators 69 are provided on the inner circumferential side of the fixing belt 51. The lubricators 69 apply a lubricant to the inner circumferential surface of the fixing belt 51 so as to reduce the frictional resistance between the fixed member 52 and the fixing belt 51 that rotates while being in contact with the fixed member 52.

Basic Operation of Fixing Device

A basic operation performed by the fixing device 5 will now be described.

When the image forming apparatus 1 is powered, the fixing device 5 is also powered and a warm-up operation starts.

In the warm-up operation of the fixing device 5, the moving mechanism 63 is activated and retains the pressing roller 58 at the second position P2 that is spaced apart from the fixing belt 51 as illustrated in FIG. 5. In this state, the halogen heaters 56 and 57 are activated, and the inner supporting roller 53 and the outer supporting roller 55 are heated, whereby the fixing belt 51 starts to be heated indirectly.

Subsequently, when the temperature detectors 67 and 68 detect that the surface temperatures of the inner supporting roller 53 and the outer supporting roller 55 have risen to or above a predetermined tentative temperature Sx, the controller 3 activates the moving mechanism 63 to move the pressing roller 58 to the first position (pressing position) P1 and also activates the first driving device 61 and the second driving device 62 to rotate the outer (heating) supporting roller 55 and the pressing roller 58, respectively. The tentative temperature Sx is set to a value at which, for example, the fixing belt 51 becomes softer than before being heated.

After the fixing belt 51 is thus heated to or above the tentative temperature Sx, the fixing belt 51 is pressed against the fixed member 52 by the pressing roller 58 (as illustrated in FIG. 2). Then, a rotational driving force generated by the rotation of the outer (heating) supporting roller 55 and the pressing roller 58 is transmitted to the fixing belt 51, whereby the fixing belt 51 starts to rotate in the direction of arrow C. Hence, while the fixing belt 51 rotates around the plural supporting rollers 53 to 55 and the fixed member 52, the fixing belt 51 is heated from the inner circumferential side and the outer circumferential side thereof by running along the inner (heating) supporting roller 53 and the outer (heating) supporting roller 55. Consequently, the entirety of the fixing belt 51 starts to be heated.

Subsequently, when the temperature detectors 67 and 68 detect that the surface temperatures of the inner supporting roller 53 and the outer supporting roller 55 have risen to or above a predetermined target temperature Sn, the controller 3 switches the operation to a fixing operation or a standby operation. If any printing request is made during the warm-up operation, the fixing operation is performed after the warm-up operation. If no printing request is made during the warm-up operation, the operation is switched to the standby operation. The target temperature Sn is a heating temperature that is ultimately required in the warm-up operation. The target temperature Sn is set to 150 to 200° C., for example.

Thus, the warm-up operation of the fixing device 5 is complete. With the execution of the above warm-up operation, the fixing belt 51 of the fixing device 5 is maintained to be at least at a temperature that enables the fixing operation. If no printing request is made during the warm-up operation, the pressing roller 58 is moved from the first position (pressing position) P1 to the second position (away position) P2 when, for example, a predetermined period of time has elapsed after the pressing roller 58 has been moved to the pressing position during the warm-up operation.

When the image forming apparatus 1 (the image forming section 2) receives a printing request, the fixing device 5 executes the fixing operation as a step for executing the printing request.

In the fixing operation, the controller 3 controls whether to turn the heating by the halogen heaters 56 and 57 on or off in accordance with the temperatures detected by the temperature detectors 67 and 68. That is, the controller 3 controls whether to turn the heating by the halogen heaters 56 and 57 on or off (whether to perform heating or to stop heating) so that the surface temperatures of the inner supporting roller 53 and the outer supporting roller 55 and ultimately the surface temperature of the fixing belt 51 are kept within an allowable fixing temperature range.

Subsequently, the controller 3 activates the moving mechanism 63 to move the pressing roller 58 from the second position (away position) P2 to the first position (pressing position) P1 and also activates the second driving device 62 to rotate the pressing roller 58. In the fixing operation, the first driving device 61 is not activated, whereby the outer supporting roller 55 is kept rotatably idle.

Thus, in the fixing device 5, the pressing roller 58 presses the fixing belt 51 against the fixed member 52 and thus forms the fixing part FN as illustrated in FIGS. 2 and 4. In this state, the elastic surface layer 582 of the pressing roller 58 is elastically deformed in such a manner as to allow the fixed member 52 to bite into a portion thereof that is in contact with the fixed member 52. Furthermore, in the fixing device 5, the fixing belt 51 whose outer circumferential surface is in contact with the pressing roller 58 receive a rotational driving force from the pressing roller 58 and rotates in the direction of arrow C. Meanwhile, the outer supporting roller 55 that is not activated and is rotatably idle rotates by following the rotation of the fixing belt 51. Hence, in the fixing operation, the fixing belt 51 rotates at a predetermined speed in the direction of arrow C by receiving only the rotational driving force transmitted thereto from the pressing roller 58.

Subsequently, if the temperature detectors 67 and 68 detect that the surface temperatures of the inner supporting roller 53 and the outer supporting roller 55 have risen to or above a lower limit Sfmin of the predetermined allowable fixing temperature range, the controller 3 executes a fixing process, in which a recording sheet 9 having an unfixed toner image MT formed thereon (second-transferred thereto) is introduced into the fixing part FN.

In this step, the recording sheet 9 having the unfixed toner image MT is guided by a lower entrance-side guiding member 65*b* and passes through the fixing part FN, i.e., the contact part between the fixing belt 51 and the pressing roller 58. The unfixed toner image MT is fixed to the recording sheet 9 by receiving heat and pressure when passing through the fixing part FN. The recording sheet 9 having undergone fixing is discharged from the fixing part FN. More specifically, the recording sheet 9 having passed through the fixing part FN is separated from both the fixing belt 51 and the pressing roller 58 and is discharged from the fixing part FN while being guided by the exit-side guiding members 66.

Thus, the fixing operation is complete. When all the steps included in the fixing operation are complete, the moving mechanism 63 is activated and moves the pressing roller 58 from the first position (pressing position) P1 to the second position (away position) P2, whereby the fixing device 5 falls into a standby state.

Detailed Configuration of Fixing Device

Figure 6:
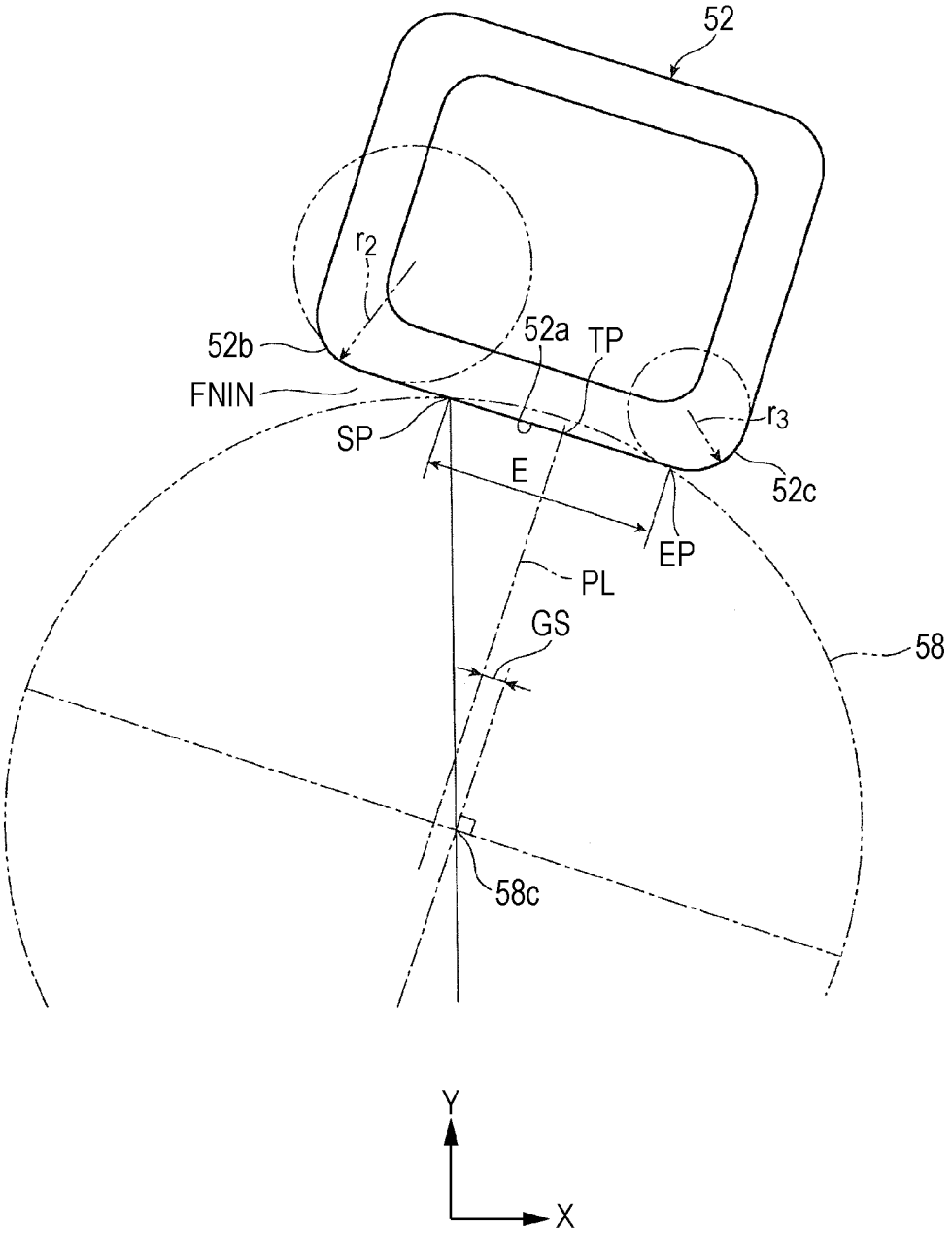
FIG. 6 is an enlarged view of the fixing device illustrated in FIG. 2 and illustrates parameters that define the position of the fixed member in an evaluation test.

As illustrated in FIGS. 4, 6, and others, the fixing device 5 is set such that a center (position) TP, in a direction of rotation D of the pressing roller 58, of a contact part 52*a* of the fixed member 52 that is in contact with the pressing roller 58 through the fixing belt 51 resides at a position that is displaced toward the entrance side of the fixing part FN with respect to a center of rotation (point) 58*c* of the pressing roller 58.

The contact part 52*a* of the fixed member 52 that is in contact with the pressing roller 58 through the fixing belt 51 substantially corresponds to the fixing part FN. The center (position) TP of the contact part 52*a* of the fixed member 52 corresponds to the center position of a length E between a contact start position SP where the pressing roller 58 starts to come into contact with the fixed member 52 (through the fixing belt 51) and a contact end position EP where the pressing roller 58 goes out of contact with the fixed member 52 (through the fixing belt 51). The length E substantially corresponds to the length (nip width) of the fixing part FN in the direction of rotation D of the pressing roller 58. An entrance-side corner 52*b* and an exit-side corner 52*c* of the fixed member 52 that are continuous with the contact part 52*a* and are on the entrance side and the exit side, respectively, of the fixing part FN each have a smoothly curved surface. Referring to FIG. 4, reference characters FNOUT denotes the exit side of the fixing part FN.

That is, the fixed member 52 is set such that, among perpendicular lines perpendicular to the line connecting the contact start position SP and the contact end position EP, one perpendicular line PL that passes through the center TP is displaced from the center of rotation 58*c* of the pressing roller 58 toward the entrance side (FNIN) of the fixing part FN by a predetermined length (displacement) GS. The displacement GS of the fixed member 52 may be set to 1.6 to 2.4 mm, although it varies a little depending on conditions such as the diameter of the pressing roller 58 and the pressure applied to the fixing part FN.

Thus, in the fixing device 5, a portion (rear portion) of the contact part 52*a* of the fixed member 52 that is on the exit side (FNOUT) of the fixing part FN is relatively strongly pressed against (the elastic surface layer 582 of) the pressing roller 58, and the pressure (nipping pressure) applied to the fixing part FN is relatively higher in a portion of the fixing part FN on the exit side (FNOUT) than the other portion of the fixing part FN. Consequently, in the fixing device 5, the recording sheet 9 having undergone fixing is stably separated from the outer circumferential surface of the fixing belt 51 at least when passing through and being discharged from the fixing part FN. Hence, the fixing device 5 provides satisfactory separability of the recording sheet 9 having undergone fixing, and the fixing operation is performed in a good manner.

In the fixing device 5 according to the first exemplary embodiment, as illustrated in FIG. 4 and others, the fixed member 52 is set such that the contact part 52*a* that is substantially flat and is in contact with the pressing roller 58 through the fixing belt 51 is tilted by a predetermined angle with respect to the horizontal direction (the X direction) in such a manner as to lift the entrance side (FNIN) of the fixing part FN. Hence, the recording sheet 9 carrying the unfixed toner image MT to be fixed is easy to be introduced into the fixing part FN.

Evaluation Test

An evaluation test for the fixing device 5 will now be described.

In the evaluation test, the displacement GS of the center TP of the contact part 52*a* of the fixed member 52 with respect to the center of rotation 58*c* of the pressing roller 58 is varied among the values given in the table in FIG. 7, and the separability of the recording sheet 9 having undergone fixing and passing through and being discharged from the fixing part FN and the state of the recording sheet 9 that has been warped (curled) are evaluated.

The fixing belt 51 used in the evaluation test includes an endless belt base made of polyamide and having a thickness of 80 μm, over which an elastic layer made of silicone rubber and having a thickness of 400 μm and a release layer made of tetrafluoroethylene-perfluoroalkylvinyl ether copolymer (PFA) and having a thickness of 50 μm are provided in that order. The fixing belt 51 has a width W of 350 mm and a length (perimeter) of 300 mm. A tension of 10 kgf (≈100 N) is applied to the fixing belt 51.

The fixed member 52 used in the evaluation test is made of iron and has a rectangular parallelpiped shape. A portion of the fixed member 52 that is to be in contact with the fixing belt 51 includes, as illustrated in FIG. 6, a substantially flat contact part 52*a* having a length (nip width) E of 12 mm, and a curved entrance-side corner 52*b* and a curved exit-side corner 52*c* that are continuous with the contact part 52*a*. The entrance-side corner 52*b* has a curved surface defined by a curvature radius $r_2$ of about 8 mm. The exit-side corner 52*c* has a curved surface defined by a curvature radius $r_3$ of about 4.0 mm. Different fixed members 52 are prepared for the respectively different displacements GS given in the table in FIG. 7. The fixed members 52 are each tilted such that the flat contact part 52*a* thereof being at an angle (angle of elevation) of about 3° with respect to the horizontal direction.

The pressing roller 58 used in the evaluation test includes a cylindrical base roller 581 made of iron and having a diameter of 40 mm and a thickness of 10 mm, over which an elastic surface layer 582 made of silicone rubber and having a thickness of 5 mm, and a release layer 583 (molded into a tubular shape) made of PFA and having a thickness of 50 μm are provided in that order. The pressing roller 58 has a flared shape with a diameter that increases from the center thereof toward two axial ends thereof. Conforming to such a shape of the pressing roller 58 in the axial direction, the fixed member 52 has a thickness that is slightly smaller at two axial ends thereof than in a central portion thereof. The pressure (nipping pressure) applied when the pressing roller 58 is at the first position (pressing position) P1 and forms the fixing part FN is set to 4.0 kgf/cm$^2$ (≈40 N/cm$^2$) at maximum. The hardness of the elastic surface layer 582 of the pressing roller 58 is adjusted such that the length E of the fixing part FN is 12 mm for each of the different displacements GS that are set for the respective fixed members 52. For example, when the displacement GS is 0 mm, the hardness of the elastic surface layer 582 is 30° in Asker C according to Japanese Industrial Standards (JIS). For another example, when the displacement GS is 4 mm, the hardness of the elastic surface layer 582 is 35° in Asker C according to JIS.

The fixing operation is performed by rotating the fixing belt 51 at a speed of about 350 mm per second and on the condition that the fixing belt 51 is heated to about 160° C., which is within the allowable fixing temperature range, by the inner supporting roller 53 and the outer supporting roller 55.

The separability is evaluated as follows. A test image (a whole-sheet image) is formed on one side of each of recording sheets 9 by using the image forming section 2 of the image forming apparatus 1 such that 10 g/cm$^2$ of a black-colored toner (a toner intended for Color 1000 Press manufactured by Fuji Xerox) adheres to the recording sheet 9 and a margin of a predetermined length (0 mm, 1 mm, 2 mm, 3 mm, 4 mm, or 5 mm) is provided at the leading end of the recording sheet 9. Subsequently, the test image is fixed by using the fixing device 5, and the smallest margin at the leading end with which the recording sheet 9 is separated from the outer circumferential surface of the fixing belt 51 in a good manner is found. The test is conducted in an environment with a temperature of 20° C. and a humidity of 50% in relative humidity (RH). The recording sheets 9 used in this test (in long edge feed) are A4-size pieces of coated paper (top-coated paper with a basis weight of 64 gsm, manufactured by Oji Paper) that have undergone wet treatment by being left in an environment at a temperature of 28° C. and a humidity of 85% in RH for 24 hours.

The state of the recording sheet 9 that has been warped is evaluated as follows. A test image (a whole-sheet image) is formed on one side of each of recording sheets 9 by using the image forming section 2 of the image forming apparatus 1 such that 10 g/cm$^2$ of the above-mentioned toner adheres to the recording sheet 9 and a margin of 2 mm is provided at the leading end of the recording sheet 9. Subsequently, the test image is fixed by using the fixing device 5, and the recording sheet 9 is discharged onto a sheet output tray, where the state of the recording sheet 9 in the sheet output tray is rated as follows.

Good: The recording sheets 9 are continuously containable without performing decurling by using a warpage correcting device (decurler) provided between the fixing device 5 and the sheet output tray (a case where decurling is not necessary).

Fair: The recording sheets 9 are continuously containable if decurling is performed by using the warpage correcting device.

Poor: The recording sheets 9 are not continuously containable even if decurling is performed by using the warpage correcting device (for example, a preceding recording sheet 9 that has already been contained is displaced or falls off by being pushed by a subsequent recording sheet 9).

The test is conducted in an environment at a temperature of 30° C. and a humidity of 80% in RH. The recording sheets 9 are the same as those used in the test for separability, except that the recording sheets 9 have not been subject to wet treatment.

In this test, the pressure (nipping pressure) at the fixing part FN of the fixing device 5 is measured for each of the different displacements GS. The pressure is measured by using a pressure measuring device (a tactile sensor manufactured by Nitta) at each of positions that are at different distances from the entrance of the fixing part FN given in the table in FIG. 7.

Figure 8:
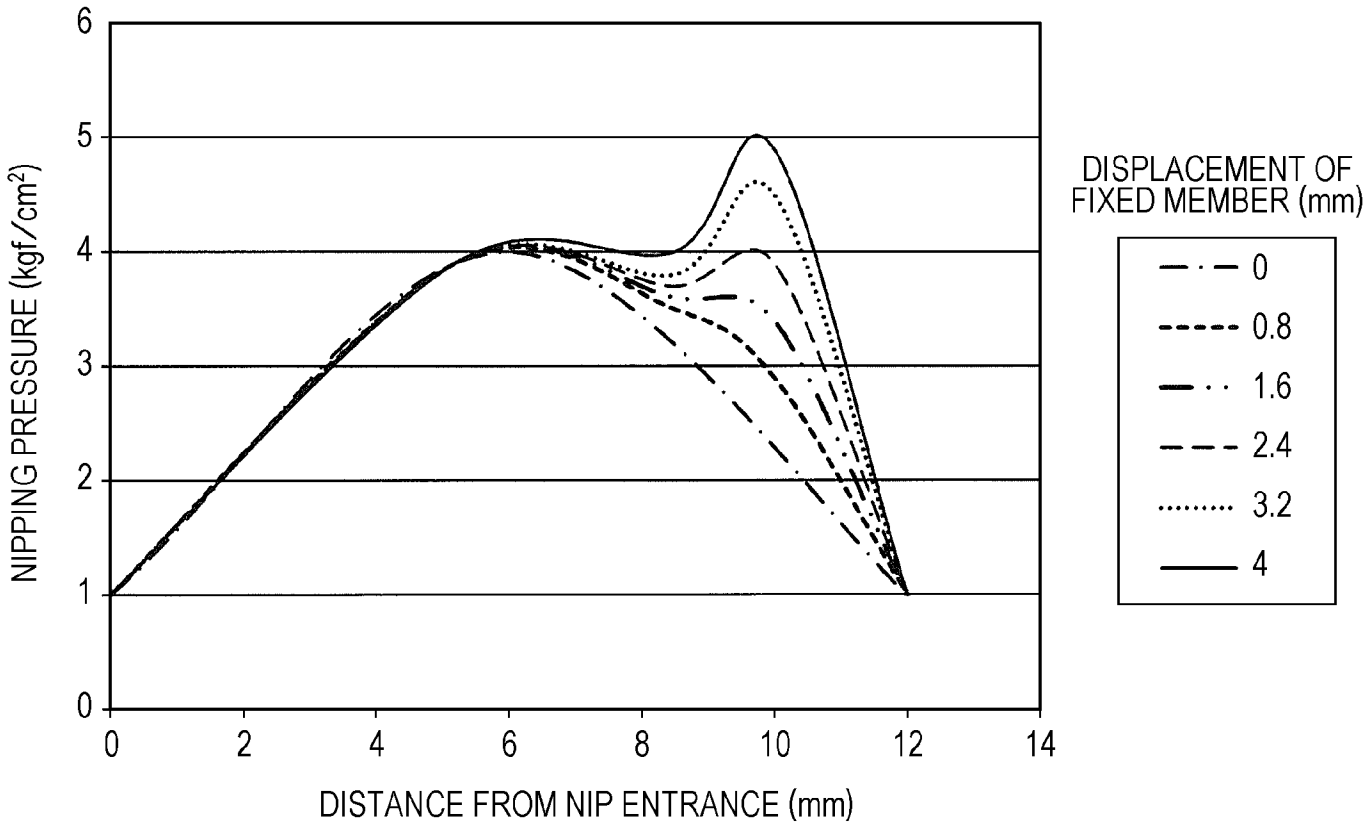
FIG. 8 is a graph illustrating the results of measurement of nipping pressure obtained in the evaluation test.

The results of the evaluation for the separability and the state of the recording sheet 9 that has been warped are summarized in the table in FIG. 7. The results of the measurement of nipping pressure are also given in the table in FIG. 7 and are graphed in FIG. 8. When the displacement GS of the fixed member 52 is 0 mm and the distance from the entrance of the fixing part FN (the nip) is 6.0 mm, the nipping pressure is 4.0 kgf/cm$^2$.

The results summarized in the table in FIG. 7 show that as the displacement GS of the center TP of the contact part 52*a* of the fixed member 52 becomes larger, the separability becomes higher (the margin at the leading end becomes shorter or zero). Furthermore, in the fixing device 5, to maintain good separability and to reduce the warpage of the recording sheet 9 (to make the length of the margin at the leading end smaller or zero), the displacement GS of the center TP of the contact part 52*a* of the fixed member 52 may be set to 0.8 mm or larger and 2.4 mm or smaller.

Second Exemplary Embodiment

Figure 9:
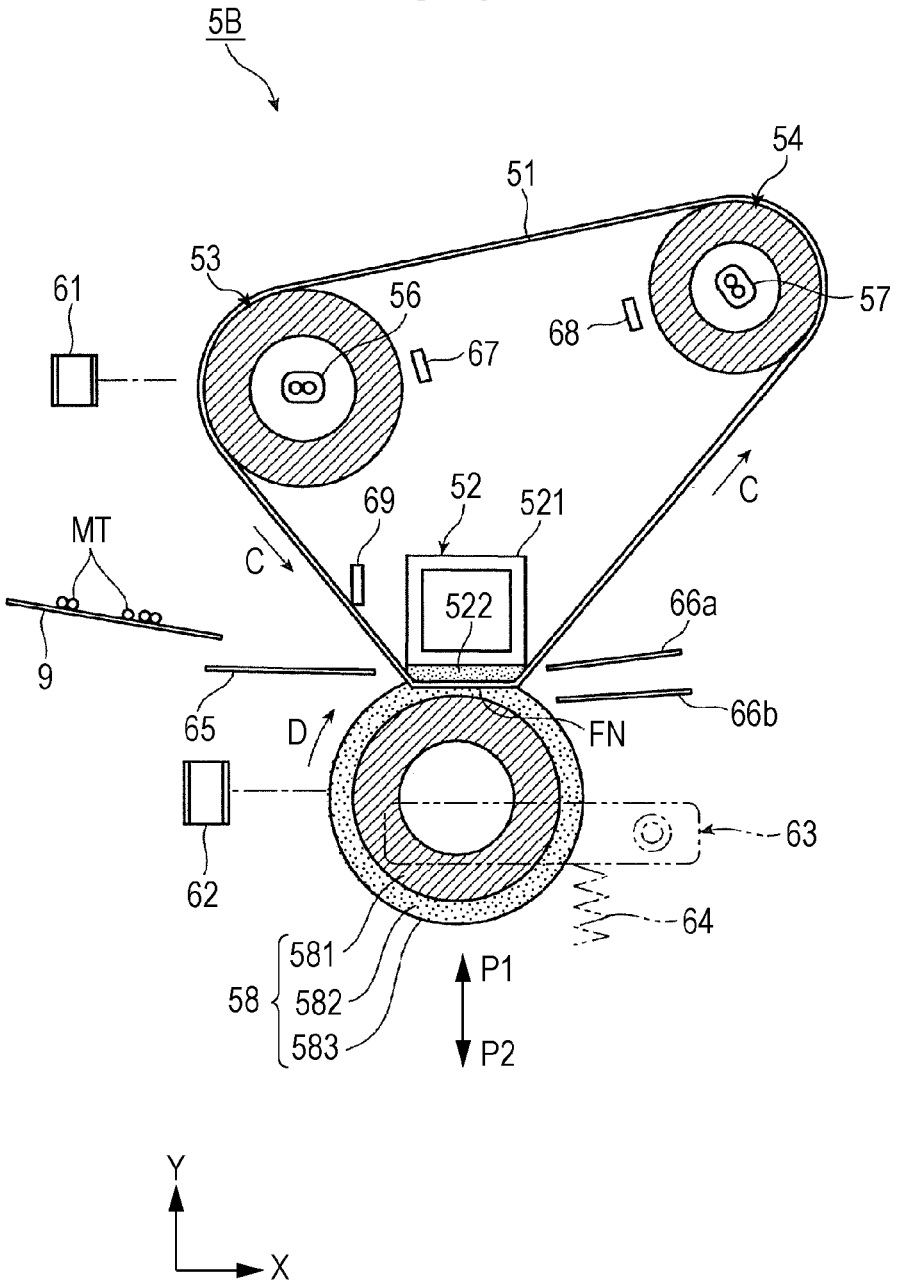
FIG. 9 is a schematic front view of a fixing device according to a second exemplary embodiment.
Figure 10:
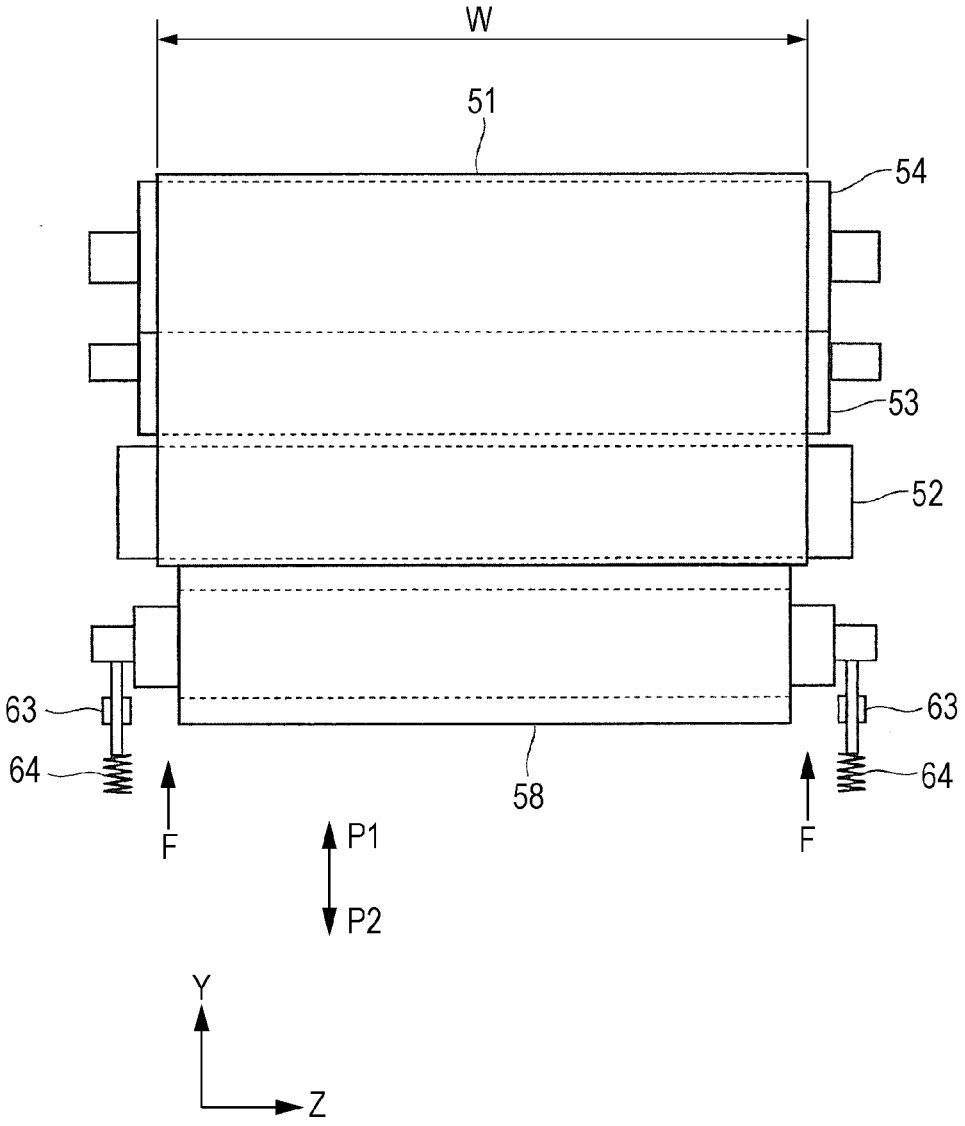
FIG. 10 is a schematic side view of the fixing device illustrated in FIG. 9.

FIGS. 9 and 10 illustrate a fixing device 5B according to a second exemplary embodiment.

The fixing device 5B according to the second exemplary embodiment includes at least the following: a fixing belt 51 as an endless belt member, a fixed member 52 fixedly provided and being in contact with the inner circumferential surface of the fixing belt 51, a first inner supporting roller 53 and a second inner supporting roller 54 rotatably supporting the fixing belt 51 in combination with the fixed member 52 by being in contact with the inner circumferential surface of the fixing belt 51, halogen heaters 56 and 57 as exemplary heating members configured to heat the fixing belt 51 via the first inner supporting roller 53 and the second inner supporting roller 54, respectively, and a pressing roller 58 configured to form a fixing part FN by pressing the fixing belt 51 against the fixed member 52 while allowing a recording sheet 9 carrying an unfixed toner image MT to pass through the fixing part FN.

That is, the fixing device 5B is the same as the fixing device 5 according to the first exemplary embodiment in which the fixing belt 51 is also heated from the outer circumferential surface thereof by the outer supporting roller 55, except that the fixing belt 51 is heated from the inner circumferential surface thereof by the first and second inner supporting rollers 53 and 54. Hence, in FIGS. 9 and 10, elements that are the same as those of the fixing device 5 according to the first exemplary embodiment are denoted by the corresponding reference numerals, and description of such elements is omitted unless otherwise required.

The inner supporting roller 53 is a cylindrical roller made of aluminum or the like and is rotatably provided on the upstream side of a position where the fixing belt 51 is in contact with the fixed member 52. The inner supporting roller 53 includes the halogen heater 56 provided in an inner space thereof. Hence, the inner supporting roller 53 functions as an inner heating roller that heats the fixing belt 51 from the inner circumferential side of the fixing belt 51. The inner supporting roller 53 is provided with a temperature detector 67 that detects the surface temperature of the inner supporting roller 53. The inner supporting roller 53 is connected to a first driving device 61 including a driving motor and so forth and thus rotates when driven. Hence, the inner supporting roller 53 functions as a driving roller that is capable of rotating the fixing belt 51 in the direction of arrow C by being in contact with the inner circumferential surface of the fixing belt 51.

The other inner supporting roller 54 is a cylindrical roller made of aluminum or the like and is rotatably provided on the downstream side of a position where the fixing belt 51 leaves the fixed member 52. The inner supporting roller 54 includes the halogen heater 57 provided in an inner space thereof. Hence, the inner supporting roller 54 functions as an inner heating roller that heats the fixing belt 51 from the inner circumferential side of the fixing belt 51. The inner supporting roller 54 also functions as a tension applying roller that applies a predetermined tension to the fixing belt 51 by supporting the fixing belt 51 while elastically pressing the fixing belt 51 from the inner circumferential side toward the outer circumferential side of the fixing belt 51.

The fixing belt 51 is rotatable by being stretched around the fixed member 52 and the inner supporting rollers 53 and 54 while being supported from the inner circumferential side thereof in such a manner as to have a substantially inverted triangular shape. The fixing belt 51 receives a predetermined tension applied thereto by the inner supporting roller 54 functioning as a tension applying roller, thereby retaining the state of being stretched around the two inner supporting rollers 53 and 54 and the fixed member 52. A basic operation (including a warm-up operation, a fixing operation, and so forth) performed by the fixing device 5B is substantially the same as that performed by the fixing device 5 according to the first exemplary embodiment, except some differences in that the fixing belt 51 is heated by the two inner supporting rollers 53 and 54 and that the fixing belt 51 is rotated in the warm-up operation by a rotational driving force exerted by the inner supporting roller 53, for example. In addition, the fixing belt 51 according to the second exemplary embodiment has a shorter perimeter than the fixing belt 51 according to the first exemplary embodiment.

As with the fixing device 5 according to the first exemplary embodiment, the fixing device 5B is set such that the center TP, in the direction of rotation D of the pressing roller 58, of the contact part 52*a* of the fixed member 52 that is in contact with the pressing roller 58 through the fixing belt 51 resides at a position that is displaced toward the entrance side of the fixing part FN with respect to the center of rotation 58*c* of the pressing roller 58 (see FIG. 4 and others). In the fixing device 5B, as illustrated in FIG. 9, the contact part 52*a*, which is substantially flat, of the fixed member 52 that is in contact with the pressing roller 58 through the fixing belt 51 extends in the horizontal direction (the X direction). Alternatively, as with the case of the fixing device 5 according to the first exemplary embodiment, the fixed member 52 may be tilted by a predetermined angle in such a manner as to lift the entrance side (FNIN) of the fixing part FN (see FIG. 4 and others).

Since the fixed member 52 of the fixing device 5B is configured as described above, the recording sheet 9 having undergone fixing is stably separated from the outer circumferential surface of the fixing belt 51 at least when passing through and being discharged from the fixing part FN, as in the case of the fixing device 5 according to the first exemplary embodiment. Hence, in the fixing device 5B also, the fixing operation is performed in a good manner.

Third Exemplary Embodiment

Figure 11:
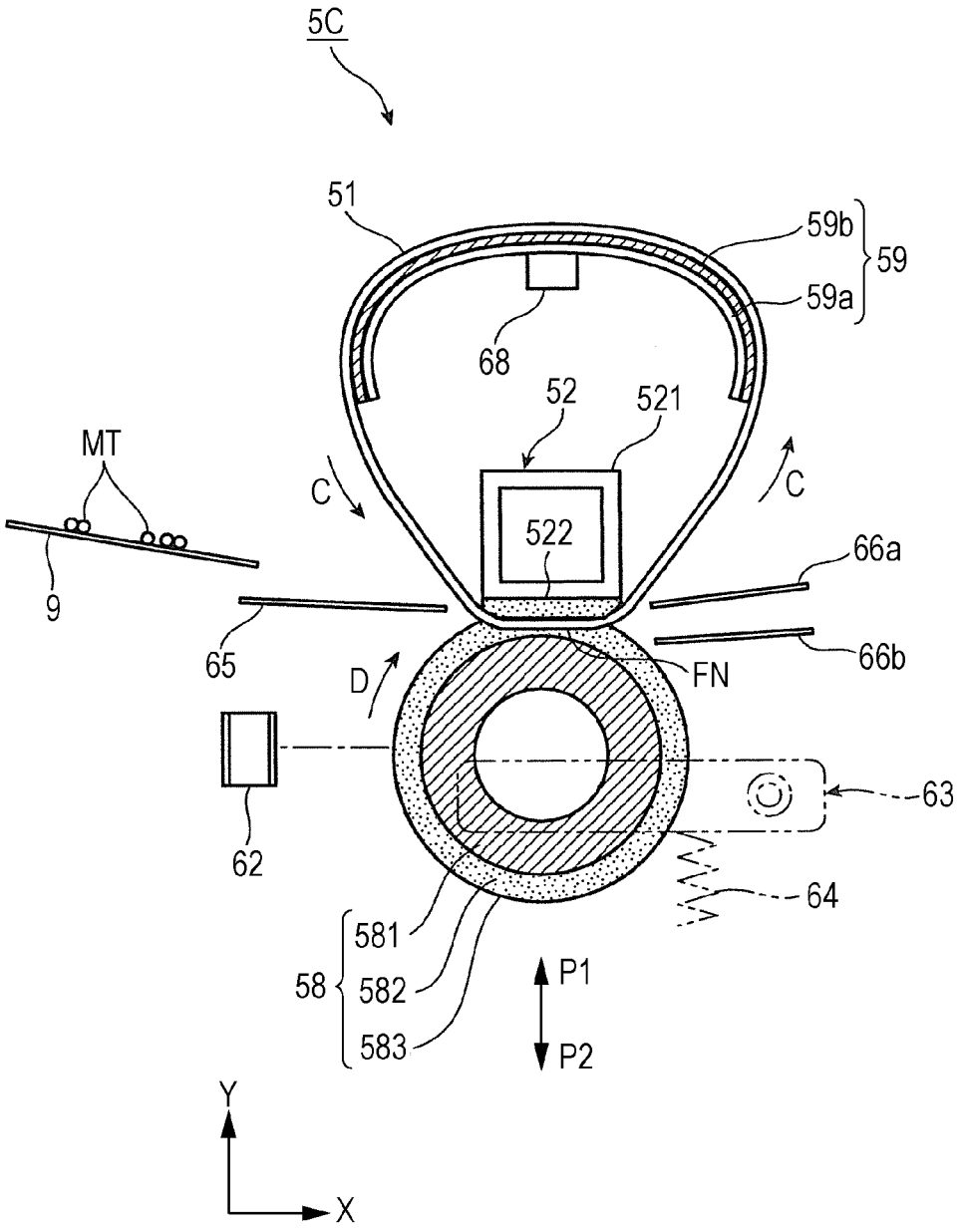
FIG. 11 is a schematic front view of a fixing device according to a third exemplary embodiment.
Figure 12:
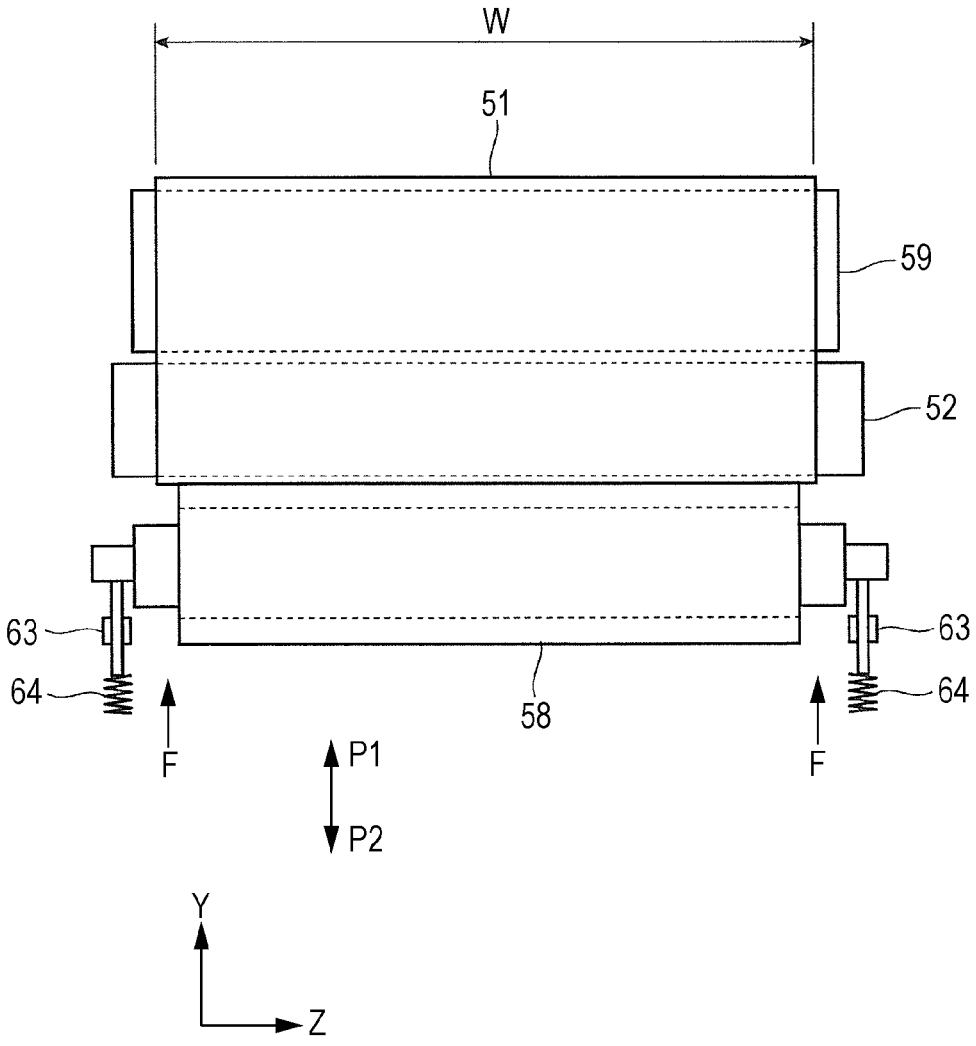
FIG. 12 is a schematic side view of the fixing device illustrated in FIG. 11.

FIGS. 11 and 12 illustrate a fixing device 5C according to a third exemplary embodiment.

The fixing device 5C according to the third exemplary embodiment has the same configuration as the fixing device 5 according to the first exemplary embodiment, except that the fixing belt 51 is supported by a heating plate 59 that is in contact with the inner circumferential surface of the fixing belt 51 and thus heats the fixing belt 51, unlike the first exemplary embodiment in which the fixing belt 51 is rotatably supported by plural supporting rollers including those functioning as heating rollers. Hence, in FIGS. 11 and 12, elements that are the same as those of the fixing device 5 according to the first exemplary embodiment are denoted by the corresponding reference numerals, and description of such elements is omitted unless otherwise required.

The heating plate 59 is, for example, a sheet-type heat generating member including a substrate 59*a* and a heat generating layer 59*b* provided thereon with an insulating layer interposed therebetween. At least an upper surface of the substrate 59*a* has an arc shape. The heating plate 59 adjusts the temperature of heat generated by the heat generating layer 59*b* in accordance with the temperature detected by a temperature detector 68, and heats the fixing belt 51 to a predetermined temperature (150 to 200° C., for example). The heating plate 59 is pressed against the inner circumferential surface of the fixing belt 51 with a predetermined load (10 kgf, for example) by a pressing member (pressing spring or the like, not illustrated). Hence, the heating plate 59, in combination with the fixed member 52, retains the fixing belt 51 to be stretched. The substrate 59*a* is, for example, a member having a predetermined thickness (about 1 mm, for example) and the entirety thereof has an arc shape. The heat generating layer 59*b* is, for example, a polyimide layer having a predetermined electric resistance and generates Joule heat when the polyimide layer is energized by a power feeding device (not illustrated).

The fixing belt 51 is rotatable by being stretched around the fixed member 52 and the heating plate 59 while being supported from the inner circumferential side thereof in such a manner as to have a substantially oval shape. A basic operation (including a warm-up operation, a fixing operation, and so forth) performed by the fixing device 5C is substantially the same as that performed by the fixing device 5 according to the first exemplary embodiment, except some differences in that the fixing belt 51 is heated by the heating plate 59 and that the fixing belt 51 is not rotated in the warm-up operation, for example. In addition, the fixing belt 51 according to the third exemplary embodiment has a shorter perimeter than the fixing belt 51 according to the first or second exemplary embodiment.

As with the fixing device 5 according to the first exemplary embodiment, the fixing device 5C is set such that the center TP, in the direction of rotation D of the pressing roller 58, of the contact part 52*a* of the fixed member 52 that is in contact with the pressing roller 58 through the fixing belt 51 resides at a position that is displaced toward the entrance side of the fixing part FN with respect to the center of rotation 58*c* of the pressing roller 58 (see FIG. 4 and others). In the fixing device 5C, as illustrated in FIG. 11, the contact part 52*a*, which is substantially flat, of the fixed member 52 that is in contact with the pressing roller 58 through the fixing belt 51 extends in the horizontal direction (the X direction). Alternatively, as with the case of the fixing device 5 according to the first exemplary embodiment, the fixed member 52 may be tilted by a predetermined angle in such a manner as to lift the entrance side (FNIN) of the fixing part FN (see FIG. 4 and others).

Since the fixed member 52 of the fixing device 5C is configured as described above, the recording sheet 9 having undergone fixing is stably separated from the outer circumferential surface of the fixing belt 51 at least when passing through and being discharged from the fixing part FN, as in the case of the fixing device 5 according to the first exemplary embodiment. Hence, in the fixing device 5C also, the fixing operation is performed in a good manner.

Other Exemplary Embodiments

The first to third exemplary embodiments concern the respective fixing devices 5, 5B, and 5C in each of which the contact part 52*a* of the fixed member 52 that is in contact with the pressing roller 58 through the fixing belt 51 is substantially flat. Alternatively, as illustrated in FIG. 13, the contact part 52*a* may have a curved shape conforming to the curved circumferential surface of the pressing roller 58.

Figure 14:
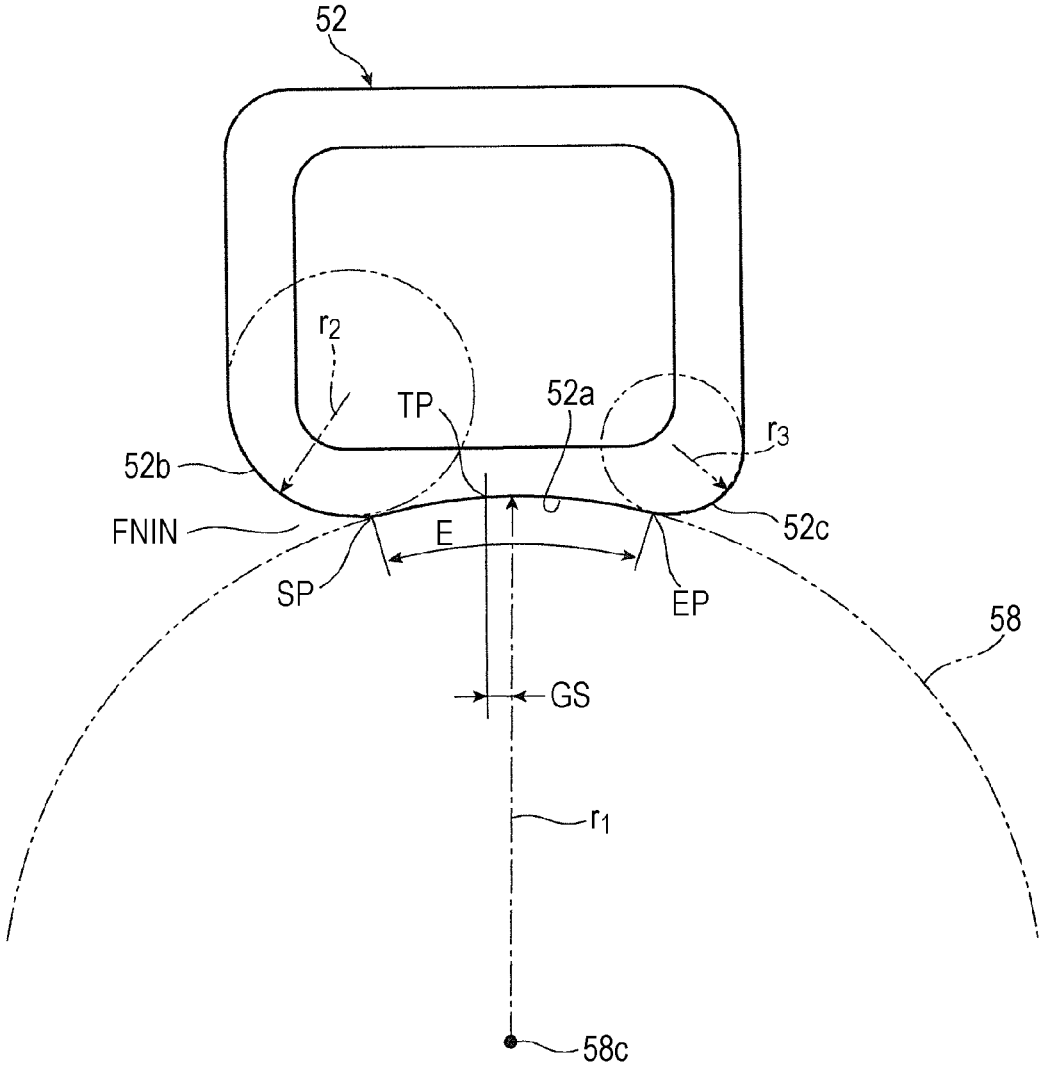
FIG. 14 is an enlarged view of the fixed member illustrated in FIG. 13.

In such a case, as illustrated in FIG. 14, the contact part 52*a* of the fixed member 52 may have a curved surface defined by a curvature radius $r_1$, which is substantially the same as the radius of the pressing roller 58. In addition, the entrance-side corner 52*b* and the exit-side corner 52*c* of the fixed member 52 that are continuous with the curved contact part 52*a* may be defined by predetermined curvature radii $r_2$ and $r_3$, respectively.

Figure 13:
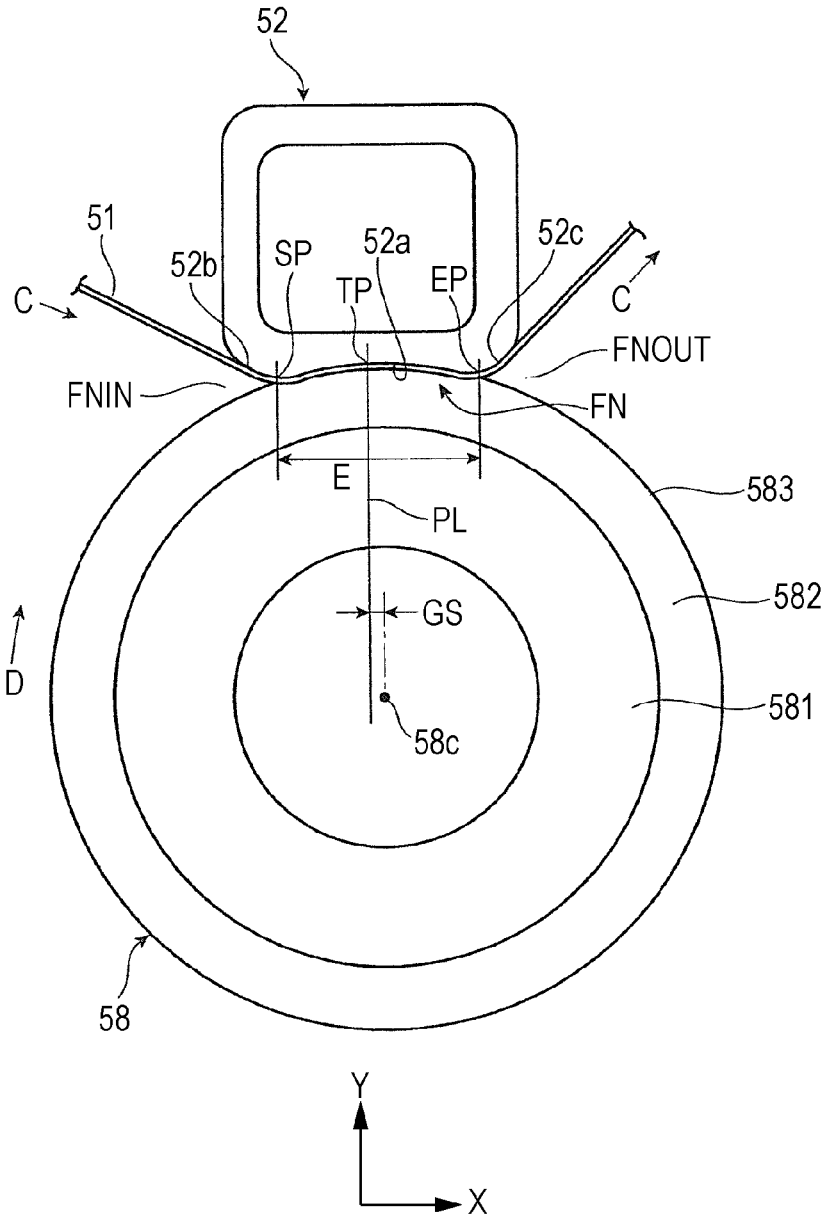
FIG. 13 is an enlarged view of a fixing device according to another exemplary embodiment and illustrates relevant parts thereof including a fixed member having another configuration.

As illustrated in FIGS. 13 and 14, the fixed member 52 including the curved contact part 52*a* is set such that the center TP, in the direction of rotation D of the pressing roller 58, of the contact part 52*a* resides at a position that is displaced toward the entrance side of the fixing part FN with respect to the center of rotation 58*c* of the pressing roller 58 by a predetermined displacement GS.

If the fixed member 52 including the curved contact part 52*a* is employed, at least good separability of the recording sheet 9 having undergone fixing is provided as in the fixing device 5 according to the first exemplary embodiment and in the fixing device 5B according to the second exemplary embodiment. Moreover, the amount of elastic deformation of the elastic surface layer 582 of the pressing roller 58 that is undergone in forming the fixing part FN is smaller than in the fixing device 5 or 5B employing the fixed member 52 having the flat contact part 52*a*. That is, the load applied to the elastic surface layer 582 is reduced. Therefore, the durability of the elastic surface layer 582 increases, and a good fixing operation is performed for a long period of time.

The contact part 52*a* of the fixed member 52 does not necessarily have a surface that is flat or curved in its entirety. For example, the contact part 52*a* may include plural curved portions defined by respectively different curvatures and arranged from the entrance side (FNIN) to the exit side (FNOUT) of the fixing part FN, or may include plural curved portions defined by respectively different curvatures and arranged in the longitudinal direction of the fixing part FN (in the direction of the axis of rotation).

The fixing devices 5, 5B, and 5C according to the first to third exemplary embodiments may each include a heating member, such as a halogen heater, provided in (an inner space of) the fixed member 52. In such a case, for example, a temperature detector that measures the temperature of a portion of the fixed member 52 that is in contact with the pressing roller 58 through the fixing belt 51 is provided so that the operation of the heating member provided in the fixed member 52 is controlled. The heating member that heats the fixing belt 51 is not limited to those that heat the fixing belt 51 via the supporting rollers that support the fixing belt 51 as described in the first and other exemplary embodiments, and may be an exclusive heating member that exclusively heats the fixing belt 51.

In each of the fixing devices 5, 5B, and 5C according to the first to third exemplary embodiments, the pressing member includes only the pressing roller 58. Alternatively, for example, the pressing roller 58 may be substituted by a pressing device including a pressing roller and a pressing belt member, the pressing roller being capable of rotating the pressing roller 58, the pressing belt member being stretched around the pressing roller and other supporting members, such as supporting rollers, and being rotatable by following the rotation of the pressing roller.

The image forming apparatus 1 including any of the fixing devices 5, 5B, and 5C only needs to include an image forming section that forms an unfixed toner image on a recording object such as a recording sheet 9, and may be an image forming apparatus that forms a monochrome image or any image forming apparatus that is capable of forming an image other than the image that is of the color and the type described in the first exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt member;

a fixed member fixedly provided and being in contact with an inner circumferential surface of the belt member;

a heating member configured to heat the belt member;

a pressing member including at least a pressing roller configured to rotate when driven, wherein the pressing roller includes an elastic surface layer, wherein the pressing roller is configured to press the belt member against the fixed member from an outer circumferential side of the belt member in such a manner as to form a fixing part through which a recording object carrying an unfixed image may pass, the elastic surface layer undergoing elastic deformation when the fixing part is formed, wherein a center, in a direction of rotation of the pressing roller, of a contact part of the fixed member that is in contact with the pressing roller through the belt member resides at a position that is displaced toward an entrance side of the fixing part with respect to a center of rotation of the pressing roller, wherein the belt member is rotatable by being stretched around the fixed member and a plurality of inner supporting rollers, wherein the belt member is tilted by a predetermined angle with respect to a horizontal direction in such a manner as to lift the entrance side of the fixing part, wherein the belt member is configured so that a first portion of the belt member extends along a first direction from a contact end position, where the belt member goes out of contact with the fixed member, to a first one of the inner supporting rollers closest to the contact end position, wherein the belt member is configured so that a second portion of the belt member extends along a second direction from a contact start position, where the belt member starts to come into contact with the fixed member, to a second one of the inner supporting rollers closest to the contact start position, and wherein the first direction is closer to a vertical direction than the second direction.

2. The fixing device according to claim 1, wherein at least the contact part of the fixed member has a curved shape conforming to a curved circumferential surface of the pressing roller.

3. An image forming apparatus comprising:

an image forming section configured to form an unfixed image on a recording object; and the fixing device according to claim 1 configured to fix the unfixed image to the recording object.

4. The fixing device according to claim 1, wherein the contact part of the fixed member that is in contact with the pressing roller through the belt member is substantially flat.

5. The fixing device according to claim 1, wherein the fixed member comprises an entrance-side corner and an exit-side corner which are continuous with the contact part and which are provided on the entrance side and the exit side, respectively, of the fixing part, and wherein the entrance-side corner and the exit-side corner each have a curved surface.

* * * * *